United States Patent [19]

Wallow et al.

[11] Patent Number: 4,850,280

[45] Date of Patent: Jul. 25, 1989

[54] PROPELLING CAGE PROJECTILE ARRANGEMENT

[75] Inventors: Peter Wallow, Düsseldorf; Karl W. Bethmann, Moers, both of Fed. Rep. of Germany

[73] Assignee: Rheinmetall GmbH, Düsseldorf, Fed. Rep. of Germany

[21] Appl. No.: 110,737

[22] Filed: Oct. 21, 1987

[30] Foreign Application Priority Data

Oct. 21, 1986 [DE] Fed. Rep. of Germany ..... 3635738

[51] Int. Cl.[4] ..... F42B 13/16

[52] U.S. Cl. ..... 102/522; 102/501; 102/517

[58] Field of Search ..... 102/501, 517, 519, 520–523, 102/703

[56] References Cited

U.S. PATENT DOCUMENTS

| | | | |
|---|---|---|---|
| 36,773 | 10/1862 | Emery | 102/523 |
| 2,616,372 | 11/1952 | Frantik | 102/523 |
| 2,669,930 | 2/1954 | Darby et al. . | |
| 2,715,874 | 8/1955 | Hablutzel et al. . | |
| 2,775,943 | 1/1957 | Ekssergian | 102/523 |
| 2,788,744 | 4/1957 | Donner | 102/523 |
| 3,447,466 | 6/1969 | Engel | 102/522 |
| 3,745,926 | 7/1973 | Mertz | 102/523 |
| 3,880,083 | 4/1975 | Wasserman et al. | 102/519 |
| 4,015,535 | 4/1977 | Bond, Jr. . | |
| 4,043,269 | 8/1977 | Ambrosini | 102/513 |
| 4,590,862 | 5/1986 | Grabarek et al. | 102/522 |
| 4,638,739 | 1/1987 | Sayles | 102/520 |

FOREIGN PATENT DOCUMENTS

| | | |
|---|---|---|
| 72584 | 2/1983 | European Pat. Off. . |
| 0152492 | 1/1984 | European Pat. Off. . |
| 2951904 | 7/1980 | Fed. Rep. of Germany . |
| 3047517 | 1/1982 | Fed. Rep. of Germany . |
| 2743732 | 7/1986 | Fed. Rep. of Germany . |
| 592192 | 7/1925 | France . |
| 2599828 | 6/1986 | France . |
| 427344 | 9/1948 | Italy . |
| WO83/1300 | 4/1983 | PCT Int'l Appl. . |
| 545956 | 2/1974 | Switzerland . |

OTHER PUBLICATIONS

Rheinmetall–Handbook on Weaponry, Rheinmetall GmbH, Düsseldorf, Federal Republic of Germany, (1982), pp. 515–518.

*Primary Examiner*—Harold J. Tudor

*Attorney, Agent, or Firm*—Spencer & Frank

[57] ABSTRACT

A propelling cage sabot is provided with longitudinal slits and its front region is provided with centering holding elements which are oriented inwardly toward the projectile while its rear region has a centering face associated with the projectile. A rear opening in the propelling cage sabot is provided with an internal thread to accommodate a screw-in element which at its front serves as a seat for a tail surface of the projectile. Compressible band-shaped elements disposed around the circumferential region of the propelling cage sabot may be provided. Conical surfaces of the propelling cage sabot facilitate insertion of the arrangement at a cadence customary in automatic equipment, with any possibly occurring insertion shock not resulting in relative axial movement of the projectile with respect to the propelling cage sabot due to a frontal holding region and the centering surface. Under the influence of the air streaming in from the front, the parts of the propelling cage sabot formed by the above-mentioned longitudinal slits and held together in the frontal region by the band-shaped element are pivoted away from the projectile and tear apart the band-shaped element, thereby releasing the projectile from the propelling cage for further unimpeded flight.

20 Claims, 1 Drawing Sheet

PROPELLING CAGE PROJECTILE ARRANGEMENT

BACKGROUND OF THE INVENTION

1. Field of the Invention

The present invention relates to a propelling cage sabot where the sabot is sleeve provided with an arrangement for centering the projectile and for securing the same in the axial direction.

2. Discussion of the Prior Art

U.S. Pat. No. 4,638,739 discloses a sabot for a high velocity projectile which is accelerated to its maximum velocity, for example by means of electromagnetic forces, and is not spin stabilized. This device is intended to combat fast moving targets, such as missiles and combat aircraft, from long distances.

A frontal section of the sabot is essentially composed of a collar type device with four identical segments. In the region of the adjacent surfaces of each segment in a respective groove, a pretensioned compression spring is disposed with one end of the spring contacting the adjacent segment. This spring acts to assist in the release of the segments from the projectile upon firing. A rear section of the sabot is provided with a receptacle having a projection for receiving the projectile. The receptacle has a circular ring shaped cross section for receiving the projectile and the projection engages the projectile in a centering manner in a rear opening of the projectile.

This prior art sabot has a number of drawbacks. In its frontal section, forces acting at the front which are opposite to the direction of acceleration must essentially cooperate in equal parts with the forces from the compression springs. This results in an unmistakable sensitivity of the arrangement which greatly impedes its manipulatability. This also applies for the tail section and forbids the obligatory cadenced operation, particularly since an intake shock is connected with the latter which may cause a relative movement of the projectile with respect to the tail section. At the same time, wedging may take place in the frontal section in such a way that subsequent acceleration of the entire arrangement cannot be realized. This adversely influences the utility of the sabot to a point of complete failure under conditions of a combat mission and such utility does not exist at all for use in connection with tubular weapons.

SUMMARY OF THE INVENTION

It is an object of the invention to provide a sabot arrangement whose manipulatability and utility are ensured even with the obligatory cadenced operation customary in automatic equipment, thus permitting use in a tubular weapon and allowing fault-free release from the projectile. Meeting these requirements is considered an essential prerequisite of a projectile for suitability for use against fast moving targets, for example missiles and combat aircraft, from long distances. A carrier system is to be operable under various conditions at an earth-bound level as well as at a level which is well above the surface of the earth. In ground-to-air combat, the combatting of fast targets near the ground also plays a significant part. In air-to-air combat, an aircraft of appropriate operative mobility as well as a satellite are conceivable as the carrier. In all cases, the smallest possible dead load of the sabot is of significant importance for allowing the projectile to have a large force of impact at the end of the trajectory. Added to this requirement, in air-to-air combat, is the restriction posed by the limited supporting capability of the carrier system. The number of target effective ammunition can be greater the lower the unavoidable dead weight percentage connected therewith.

Although DE-OS No. 2,951,904 discloses a propelling cage sabot for a subcaliber projectile which is configured with the objective of having a comparatively small inherent mass, it requires elements which project beyond the circumference of the projectile so as to ensure a mutual form lock in the acceleration direction which is absolutely necessary during passage through the tube. However, such a measure or a comparable measure under the given conditions would lead to such a drastic increase in the coefficient of air resistance that the reduction in velocity of the projectile inevitably concomitant therewith would result in the latter being useless for combatting fast air targets at long distances.

A propelling cage sabot according to DE-OS No. 3,318,972 is also unsuitable to solve the problems on which the invention is based since, aside from its considerable inherent mass, malfunction-free release from the projectile which is configured to stabilize resistance is not ensured.

BRIEF DESCRIPTION OF THE DRAWINGS

The invention will be described in greater detail below with reference to three embodiments which are illustrated essentially schematically in the drawing figures.

Figure 1:
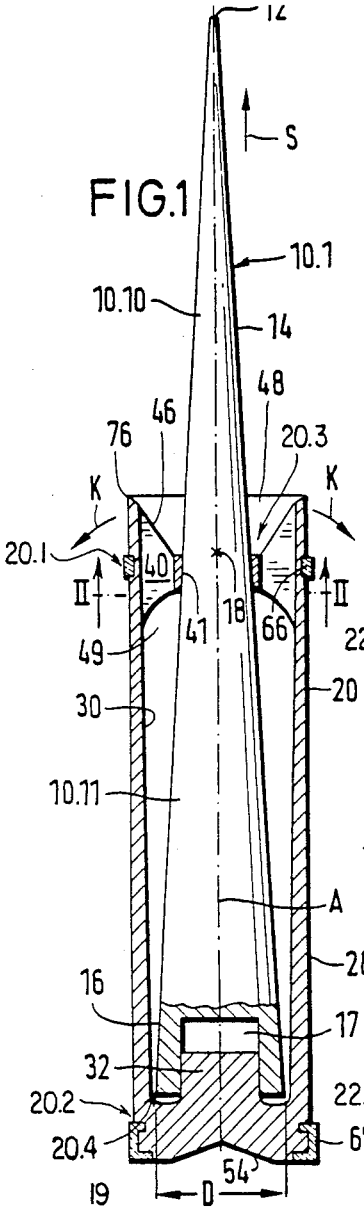
FIGS. 1, 3 and 5 are simplified longitudinal sectional of respective embodiments of propelling cage sabot arrangements according to the invention; views
Figure 2:
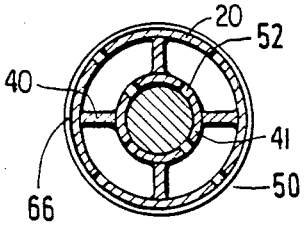
FIGS. 2 and 4 are cross-sectional views seen on lines II—II and IV—IV, respectively, in FIGS. 1 and 3.

According to FIG. 1, a pointed conical rotationally symmetrical projectile 10.1 having a large length (L) to diameter (D) ratio is disposed in a thin-walled, sleeve shaped propelling cage sabot 20 which is closed at its rear end, e.g. the end facing away from the point 12 of the projectile. The outer wall of the propelling cage sabot 20 is essentially circularly and is provided with longitudinal slits 50 (see FIG. 2) which extend from the front edge of the cage 20 to a point adjacent its closed rear end so that the sleeve is essentially formed of longitudinally extending profiled elements which surround at least the rear section 10.11 of the projectile 10.1. Extending radially inwardly from the inner surface 30 of the respective sleeve elements of the cage 10 adjacent the front end thereof are a plurality of web-like holding elements 40 whose ends 41 lie against and engage the circumferential surface 14 of projectile 10.1 in the region of the center of gravity 18 of the projectile and thereby form a frontal centering means 20.3. As can be seen in FIG. 2 the inner ends 41 of the holding elements 40 form a ring which circumferentially surrounds the projectile 10.1 and which is provided with longitudinally extending through slits 52. The engagement of the projectile surface 14 by the inner ends 41 likewise secures the projectile against axial movement relative to the propelling cage 20. A rear centering means 20.4 is provided in the region of the tail section 16 of the projectile by a central shaft stub 32 which engages in a cavity 17 formed in the rear end surface of projectile 10.1 and thus forms an annular receptical in the inner rear end surface of the cage 20 for the tail section 16.

The rear of propelling cage sabot 20 is delimited by a tail surface 54 in whose the outer vicinity circumferential face 28 is provided with a radially deformable band-shaped element 68. In the region of the centering means 20.3, there is also provided a plurality of radially compressible elements 66 which, for the purpose of better manipulation and handling of the projectile arrangement, and preferably connected together to form a band so as to secure the engagement between the surfaces 14 and 41. At the front, the holding elements 40 are provided with relatively narrow edge flow surfaces 46 which are inclined with respect to the longitudinal axis A of the projectile and form part of a frontal air pocket 48. These surfaces simultaneously delimit air flow passages (not identified) into an air accumulation chamber 49 formed between the circumferential surface 14 and interior surface 30 of the propelling cage 20, as can be seen in FIG. 2.

The front section 10.10 of projectile 10.1 is made of a high density material, with this high density preferably being the result of a high percentage of tungsten. This is followed by a tail section 10.11 of a comparatively lower apparent density. In this way, the center of gravity 18 of the projectile moves sufficiently forward of the point at which the air attacks, known as the center of press (not shown) when seen in the direction of acceleration S.

Figure 3:
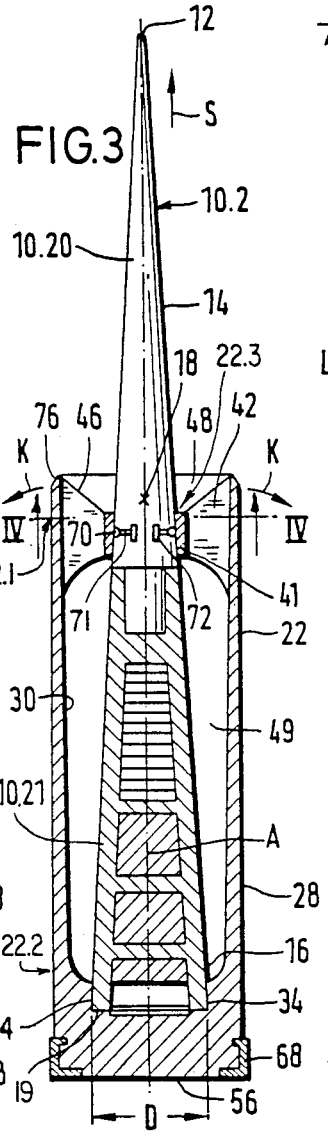
Figure 4:
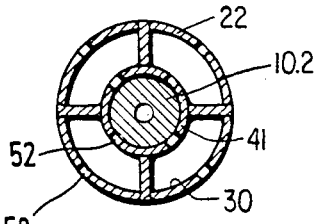

Except for the interior arrangement in tail section 10.21 of the projectile 10.2, projectile 10.2 and propelling cage 22 of FIGS. 3 and 4 differ from that in FIG. 1 particularly by the openings 70 in the projectile 10.2, with radially inwardly projecting, shear-stressable elements 71 at holding elements 46 which engage into openings 70 on the side of the projectile 10.2 to thus provide an axial fix of projectile 10.2 in propelling cage sabot 22. In this embodiment as well, the requirement is met that the center of gravity 18 of the projectile is sufficiently far ahead of the point at which the air attacks (again not shown) and in the front section 10.20 of projectile 10.20 of projectile 10.2 in the vicinity, but in front, of the area of engagement of the surfaces 14 and 41.

Figure 5:
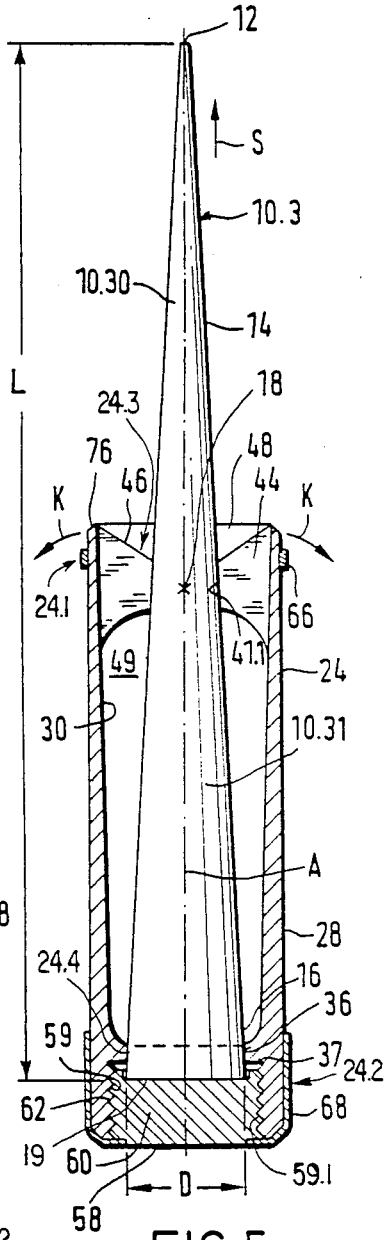

According to the embodiment of FIG. 5, propelling cage sabot 24, whose cross section (not shown) essentially corresponds to that of FIGS. 2 and 4, has a rear opening 59 provided with an internal thread 59.1 and with an inner diameter which is larger than the largest diameter D of projectile 10.3 so that the projectile can be inserted into the cage 24 via the opening 59. In order to both center and axially secure the projectile 10.3 in the propelling cage 24, the inner surface 30 of the cage 24 is provided with an inwardly directed centering surface 36 directly in front of the threaded opening 59, and with this inner surface 36 being longitudinally tapered so as to conform to the conical circumferential surface 14 of the projectile 10.3 when it is within the cage 24. The inner surfaces 41 of the holding elements are similarly conically tapered so as to securely engage the corresponding portion of the surface 14 of projectile 10.3, whereby the surfaces 36 and 41 essentially form parts of a conical support jacket for the projectile 10.3. As a result of this arrangement, double axial securing and centering of projectile 10.3 in propelling cage 24 is ensured. To close the opening 59 and properly position projectile 10.3 in propelling cage 24, a screw-in element or plug 60 with an external thread 62 is provided. Plug 60 has a planar, circular receptacle (not numbered) for receiving the tail surface 19 of projectile 10.3 at its front surface and is delimited at the rear by a tail surface 58. In this embodiment, the band-shaped compressible element 68 extends over the tail surface 58 sufficciently to cover the threads 59.1 and extends along the outer surface 28 beyond the region of the centering and securing surface 36 in order to provide the necessary seal, if required, and sufficient radial contact pressure when the projectile is disposed in a high speed accelerationd device. The radially compressible elements 66 associated with the front of receptacle 24.3 may also be connected with one another, as already described in connection with the first embodiment, and may be given a band shape.

In this embodiment the projectile 10.3 likewise has the front and rear sections 10.30 and 10.31 corresponding to those of FIGS. 1 and 3. However, as shown in FIG. 5, in this embodiment the center of gravity is located between the end surfaces 41.

A frontal conical surface 76 at each one of the illustrated propelling cage sabots facilitates axial insertion of the respective arrangement in the starting position into a high-speed acceleration device and at a cadence customary in automatic devices. The materials of which the respective propelling cage sabots are made are adapted in such a manner that acceleration specific pressure forces exerted by the respective projectile, which has the lowest possible percentage of dead weight, can be reliably absorbed. When the arrangement according to the present invention leaves the respective high-speed acceleration device, interior accumulation chamber 49 is already filled with air to such an extent that the effect of the air now flowing in from the outside causes the longitudinally extending sleeve elements (formed in the propelling cage sabot by longitudinal slits 50 and 52) to be pivoted like levers in the direction of arrows K, resulting in the tearing of any band-shaped element 66 and release of the projectile by the ends 41 of the holding element 40, 42 or 44. A region 37 of propelling cage sabot 24, to which the slits 50 extend, advantageously acts as a desired breaking point so that projectile 10.3 is able to continue its movement in direction S.

In the embodiment according to FIG. 3, the mentioned elements 71 at projections 46 leave the corresponding openings 70 in projectile 10.2 when the elements are pivoted in the direction of arrows K. In this case, a smooth outer surface 14 on projectile 10.2 can again be realized, by means of an inertial body (not shown) which is able to move along the longitudinal axis A of the projectile, or by means of filler members 72 which are radially movable with the aid of springs.

In the embodiments according to FIGS. 1 and 3, the frontal centering means 20.3; 22.3 is associated with radially compressible friction lock elements 41. According to FIG. 1, they can take care of axially fixing projectile 10.1 in propelling cage sabot 20 with a comparatively small intake shock. According to FIG. 3, they support the effect of elements 71. Such friction lock elements 41 may also be arranged in the embodiment according to FIG. 5 in the region of the first centering receptacle 24.3, although they are not illustrated there. Since in FIG. 5, a form lock is already realized between projectile 10.3 and propelling cage sabot 24 in the rear centering receptacle 24.2 overdefinition can be avoided by the contact surface 41.1 and the corresponding rigidity of projection 44.

Since an opening path K associated with elements 71 (FIG. 3) is a circular arc which has a large radius, adverse influence on the behavior of the projectile can be avoided.

The rear side region of the screw-in element 60 shown in FIG. 5 may advantageously be given the outer diameter of the propelling cage sabot 24. For example, the rearward boundary surface of the respective region will be able to take on the entire gas pressure—particularly in tubular weapons—and thus carry the propelling cage sabot 24. This may considerably increase the strength behavior during acceleration to high velocities.

Discussion of the materials involved has been omitted. Teachings directed toward this subject are of course subject, in addition to the requirement for low dead weight and good manipulatability under different conditions of use, to the requirement for usability in various high-speed acceleration devices, regardless of whether the energy for acceleration is available in a chemical and/or an electrical form. The person of average skill in the art should be aware of these criteria and the latter may extend to slight structural modifications. These may become necessary due to different shapes of the inner cross-section/caliber and no detailed discussion thereof is required here.

We claim:

1. A propelling cage sabot for a subcaliber projectile which is configured as a rotationally symmetrical pointed cone having a smooth surface extending over the entire length of the projectile, the projectile having a large length to diameter ratio and being resistance stabilized, said sabot comprising;

a propelling cage configured as a cylindrical sleeve which is open at its front end and surrounds at least a rear section of the projectile and which is closed at its rear end by an end surface, said sleeve having an outer cylindrical surface sized to the full-caliber cross section of a high-speed acceleration device, and an inner surface which is spaced from the pointed conical circumferential surface of the projectile to provide an air collection chamber within said cage between said sleeve and a projectile;

means for centering a projectile within said propelling cage including a centered receptacle provided within said propelling cage at its rear end for receiving a tail end of the rear section of a projectile, and a plurality of narrow web-like holding elements disposed adjacent said front end of said sleeve and extending radially inwardly from said inner surface of said sleeve for engaging the circumferential surface of a projectile with their respective inner ends, and with at least said plurality of holding elements simultaneously securing a projectile against axial movement relative to said propelling cage, said inner surface of said sleeve and said holding elements defining open air channels into said air collection chamber and said holding elements each having a frontal surface which is inwardly radially tapered; and a plurality of longitudinal slits formed in said sleeve and extending from the front end of said sleeve so as to divide said sleeve into a plurality of sleeve elements which extend from the front to a rear full caliber region of said cage adjacent said end surface, with said sleeve elements, under the influence of air flowing into said chamber via said open end of said sleeve after the sabot projectile leaves the high-speed acceleration device, being pivotable in the manner of a lever in a direction opposite to the acceleration direction of the arrangement so as to release the projectile from said propelling cage for further unimpeded flight.

2. A propelling cage sabot as defined in claim 1 wherein: said inner ends of said plurality of holding elements form a ring for surrounding and contacting the circumferential surface of a projectile, with said ring being provided with longitudinally extending through slits between each pair of adjacent said holding elements.

3. A propelling cage sabot as defined in claim 2, wherein said rear end surface of said propelling cage is provided with a centrally disposed opening having an internal thread and with the diameter of said opening being larger than the largest diameter of the projectile; and a circularly cylindrical screw-in plug is disposed in said opening.

4. A propelling cage sabot as defined in claim 3 wherein said inner ends of said holding elements are longitudinally tapered and shaped to conform to the portion of the circumferential surface of a projectile engaged by same so as to axially secure the projectile.

5. A propelling cage sabot as defined in claim 4 wherein a portion of said side wall of said receptacle is longitudinally tapered and shaped to conform to the peripheral surface of the tail section of the projectile to engage same, so as to further axially secure the projectile.

6. A propelling cage sabot as defined in claim 1 wherein said inner ends of said holding elements are provided with radially extending pins for engaging in openings in the surface of a projectile so as to axially secure the projectile.

7. A propelling cage sabot as defined in claim 1 further comprising a radially compressible band-shaped element disposed on the outer circumferential surface of said sleeve in the region of at least one of the rear end of said propelling cage and the area of engagement of said holding elements with the surface of a projectile.

8. A propelling cage sabot as defined in claim 7 wherein respective said band shaped elements are disposed in the region of said rear end of said cage and in the region of said area of engagement of said holding elements.

9. A propelling cage sabot as defined in claim 1 wherein said inner ends of said holding elements are provided with radially compressible elements for forming a friction locking engagement with the surface of a projectile.

10. A propelling cage sabot as defined in claim 1 wherein a portion of said side wall of said receptacle is longitudinally tapered and shaped to conform to the peripheral surface of the tail section of the projectile to engage same, so as to further axially secure the projectile.

11. A propelling cage sabot projectile for firing from a high-speed acceleration device comprising in combination:

a subcaliber projectile configured as a rotationally symmetrical pointed cone having a smooth surface extending over the entire length of said projectile, said projectile having a large length to diameter ratio and being resistance stabilized;

a propelling cage configured as a cylindrical sleeve which is open at its front end and surrounds at least a rear section of said projectile and which is closed at its rear end by an end surface, said sleeve having an outer cylindrical surface sized to the full-caliber cross section of a high-speed acceleration device for the projectile arrangement, and an inner surface which is spaced from the pointed conical circumferential surface of said projectile to provide an air collection chamber within said cage between said sleeve and said projectile;

means for centering said projectile within said propelling cage including a centered receptacle provided within said propelling cage at its rear end for receiving a tail end of said rear section of said projectile, and a plurality of narrow web-like holding elements disposed adjacent said front end of said sleeve and extending radially inwardly from said inner surface of said sleeve toward said circumferential surface of said projectile and engaging said circumferential surface with their respective inner ends, and with at least said plurality of holding elements simultaneously securing said projectile against axial movement relative to said propelling cage, said inner surface of said sleeve and said holding elements defining open air channels into said air collection chamber, and said holding elements each having a frontal surface which is inwardly radially tapered; and a plurality of longitudinal slits formed in said sleeve and extending from the front end of said sleeve so as to divide said sleeve into a plurality of sleeve elements which extend from the front to a rear full caliber region of said cage adjacent said end surface, with said sleeve elements, under the influence of air flowing into said chamber via said open end of said sleeve after said projectile arrangement leaves the high-speed acceleration device, being pivotable in the manner of a lever in a direction opposite to the acceleration direction of the arrangement so as to release said projectile from said propelling cage for further unimpeded flight.

12. A propelling cage sabot projectile arrangement as defined in claim 11 wherein: said inner ends of said plurality of holding elements form a ring which surrounds and contacts said circumferential surface of said projectile, with said ring being provided with longitudinally extending through slits between each pair of adjacent said holding elements.

13. A propelling cage sabot projectile arrangement as defined in claim 11, wherein: said rear end surface of said propelling cage is provided with a centrally disposed opening having an internal thread and with the diameter of said opening being larger than the largest diameter of said projectile; and a circularly cylindrical screw-in plug is disposed in said opening.

14. A propelling cage sabot projectile arrangement as defined in claim 13 wherein said inner end surfaces of said holding elements are longitudinally tapered and shaped to conform to the engaged portion of said circumferential surface of said projectile so as to axially secure said projectile.

15. A propelling cage sabot projectile arrangement as defined in claim 14 wherein a portion of said side wall of said receptical is longitudinally tapered and shaped to conform to the peripheral surface of said tail section of said projectile and which engages same, so as to further axially secure said projectile.

16. A propelling cage sabot projectile arrangement as defined in claim 11 wherein radially extending pins extend radially from the inner ends of said holding elements and engage in openings in said surface of said projectile so as to axially secure said projectile.

17. A propelling cage sabot projectile arrangement as defined in claim 11 wherein: said projectile has a center of gravity which is disposed forward of the center of air pressure during flight; and said holding elements engage said projectile in close vicinity to the center of gravity of said projectile.

18. A propelling cage sabot projectile arrangement as defined in claim 11 further comprising a radially compressible band-shaped element disposed on the outer circumferential surface of said sleeve in the region of at least one of the rear end of said propelling cage and the area of engagement of said holding elements with said surface of said projectile.

19. A propelling cage sabot projectile arrangement as defined in claim 18 wherein respective said band shaped elements are disposed in the region of said rear end of said cage and in the region of said area of engagement of said holding elements.

20. A propelling cage sabot as defined in claim 11 wherein a portion of said side wall of said receptacle is longitudinally tapered and shaped to conform to the peripheral surface of the tail section of said projectile and which engages same, so as to further axially secure said projectile.

* * * * *